US008042619B2

(12) United States Patent
Bennett

(10) Patent No.: US 8,042,619 B2
(45) Date of Patent: Oct. 25, 2011

(54) METHODS AND APPARATUS FOR EXTINGUISHING FIRES

(75) Inventor: Joseph Michael Bennett, Gallatin, TN (US)

(73) Assignee: Firetrace USA, LLC, Scottsdale, AZ (US)

( * ) Notice: Subject to any disclaimer, the term of this patent is extended or adjusted under 35 U.S.C. 154(b) by 1750 days.

(21) Appl. No.: 10/443,302

(22) Filed: May 21, 2003

(65) Prior Publication Data

US 2004/0016551 A1 Jan. 29, 2004

Related U.S. Application Data

(63) Continuation-in-part of application No. 09/920,179, filed on Aug. 1, 2001, now abandoned.

(60) Provisional application No. 60/382,398, filed on May 21, 2002, provisional application No. 60/430,912, filed on Dec. 3, 2002.

(51) Int. Cl.
*A62C 2/00* (2006.01)

(52) U.S. Cl. ..... 169/46; 169/27; 169/78; 252/2; 252/8; 252/8.05; 252/601; 252/602

(58) Field of Classification Search ..... 169/46, 169/27, 78, 43; 252/2, 3, 4, 5, 7, 8, 601, 252/602, 603, 606
See application file for complete search history.

(56) References Cited

U.S. PATENT DOCUMENTS 2,880,172 A * 3/1959 McCutchan ..... 252/2
2,911,049 A 11/1959 Lee et al.
3,698,597 A 10/1972 Burke
3,840,075 A * 10/1974 Schmitt ..... 169/43
3,930,541 A 1/1976 Bowman et al.
4,121,666 A 10/1978 Rozniecki
4,132,271 A 1/1979 Mikaila
4,194,979 A 3/1980 Gottschall
4,215,752 A 8/1980 Waller
4,226,727 A * 10/1980 Tarpley et al. ..... 252/8
4,251,579 A 2/1981 Lee et al.
4,262,749 A 4/1981 Monte
4,616,049 A * 10/1986 Thompson et al. ..... 523/212

(Continued)

FOREIGN PATENT DOCUMENTS

FR 635827 3/1928

(Continued)

OTHER PUBLICATIONS

The book "Principles of Fire Protection Chemistry, Second Edition" (Raymond Friedman, Nov. 1989), pp. 82-86, Table 6.5 and Figure 6.11 and p. 85.

(Continued)

*Primary Examiner* — Dinh Nguyen
(74) *Attorney, Agent, or Firm* — The Noblitt Group, PLLC

(57) ABSTRACT

A fire control system according to various aspects of the present invention includes an extinguishant having a suppressant and a thermal absorbant. The suppressant is configured to suppress the fire. The thermal absorbant is configured to absorb heat from the fire. In one embodiment, the thermal absorbant is configured to absorb thermal radiation from the fire and inhibit reflection of thermal radiation from the suppressant and/or other surfaces back into the fire. In additional and alternative embodiments, the thermal absorbant may be configured to transfer heat into the surface and/or interior of suppressant particles or droplets to promote activation of the suppressant.

63 Claims, 4 Drawing Sheets

U.S. PATENT DOCUMENTS

| | | | | | |
|---|---|---|---|---|---|
| 4,652,383 | A | | 3/1987 | Tarpley, Jr. et al. | |
| 4,950,410 | A | | 8/1990 | Pennartz | |
| 5,053,147 | A | | 10/1991 | Kaylor | |
| 5,056,602 | A | * | 10/1991 | Tapscott et al. | 169/46 |
| 5,091,097 | A | | 2/1992 | Pennartz | |
| 5,132,030 | A | | 7/1992 | Marx | |
| 5,275,243 | A | | 1/1994 | Williams et al. | |
| 5,304,313 | A | | 4/1994 | Berger | |
| 5,393,437 | A | | 2/1995 | Bower | |
| 5,461,098 | A | * | 10/1995 | Hitchcock et al. | 524/297 |
| 5,492,179 | A | | 2/1996 | Spector et al. | |
| 5,575,339 | A | | 11/1996 | Alhamad | |
| 5,588,493 | A | | 12/1996 | Spector et al. | |
| 5,609,210 | A | | 3/1997 | Galbraith et al. | |
| 5,762,145 | A | | 6/1998 | Bennett | |
| 5,833,874 | A | | 11/1998 | Stewart et al. | |
| 5,938,969 | A | | 8/1999 | Morton | |
| 6,019,177 | A | | 2/2000 | Olander | |
| 6,065,545 | A | | 5/2000 | Williams | |
| 6,217,788 | B1 | | 4/2001 | Wucherer et al. | |

FOREIGN PATENT DOCUMENTS

| | | |
|---|---|---|
| GB | 1380420 | 1/1975 |
| GB | 1445832 | 8/1976 |
| GB | 1453836 | 10/1976 |
| GB | 1454492 | 11/1976 |
| GB | 1454493 | 11/1976 |
| GB | 1496652 | 12/1977 |
| GB | 1547568 | 6/1979 |
| JP | 56-034724 | 4/1981 |
| JP | 04-135574 | 5/1992 |
| JP | 2000-84105 | 3/2000 |

OTHER PUBLICATIONS

The book "Fundamentals of Heat and Mass Transfer, Third Edition" (Incropera and DeWitt, John Wiley & Sons, Inc., 1981), pp. 695-749, Fig. 12.23 on p. 725.

* cited by examiner

METHODS AND APPARATUS FOR EXTINGUISHING FIRES

CROSS-REFERENCES TO RELATED APPLICATIONS

This application claims the benefit of U.S. Provisional Patent Application No. 60/382,398, filed May 21, 2002; and U.S. Provisional Patent Application No. 60/430,912, filed Dec. 3, 2002; and is a continuation-in-part of U.S. Nonprovisional patent application Ser. No. 09/920,179, filed Aug. 1, 2001 now abandoned, and of U.S. Nonprovisional patent application Ser. No. 10/214,497, filed Aug. 8, 2002, and incorporates the disclosure of each application by reference.

FIELD OF THE INVENTION

The invention relates to methods and apparatus for controlling fires and flammable materials.

BACKGROUND OF THE INVENTION

Flammable and otherwise hazardous materials play an important role in the everyday lives of most people. Most people encounter flammable materials, such as gasoline, engine oil, and natural gas, without danger. Because the flammable materials are contained, they typically present no problem for those that are nearby.

When the flammable materials become uncontained, however, the materials can injure or kill, such as when the container is damaged and the material escapes. Fire extinguishing systems play a key role in controlling and extinguishing fires. Numerous materials offer various properties for quenching fires and find applications in various types of fire extinguishing systems, including dry powders, liquids, and foams. Most of these materials directly attack the source of the fire. In particular, the materials are intended to directly cool the fire, deprive the fire of fuel or oxygen, or otherwise interfere with the chemical combustion process that sustains the fire.

SUMMARY OF THE INVENTION

A fire control system according to various aspects of the present invention includes an extinguishant having a suppressant and a thermal absorbant. The suppressant is configured to suppress the fire. The thermal absorbant is configured to absorb heat from the fire. In one embodiment, the thermal absorbant is configured to absorb thermal radiation from the fire and inhibit reflection of thermal radiation from the suppressant and/or other surfaces back into the fire. In additional and alternative embodiments, the thermal absorbant may be configured to transfer heat into the surface and/or interior of suppressant particles or droplets to promote activation of the suppressant.

BRIEF DESCRIPTION OF THE DRAWING FIGURES

A more complete understanding of the present invention may be derived by referring to the detailed description when considered in connection with the following illustrative figures. In the following figures, like reference numbers refer to similar elements and steps.

Figure 3A:
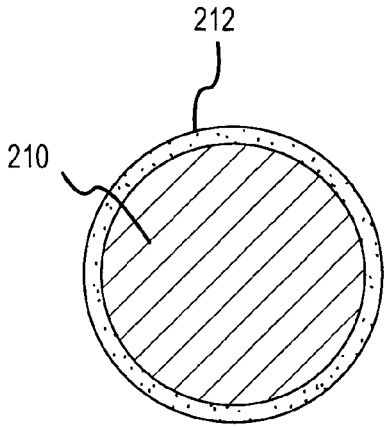
Figure 3B:
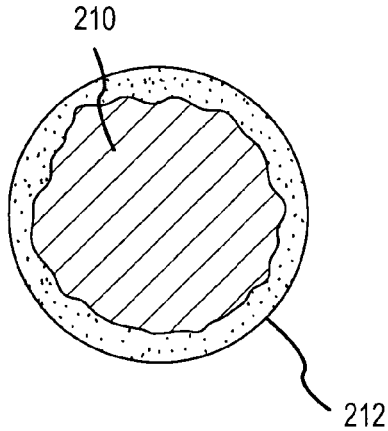
Figure 4:
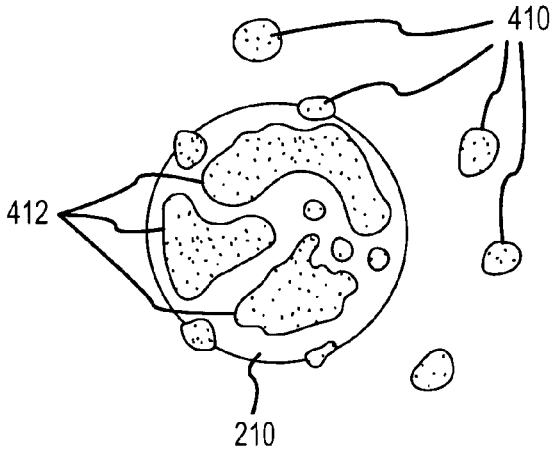
Figure 5:
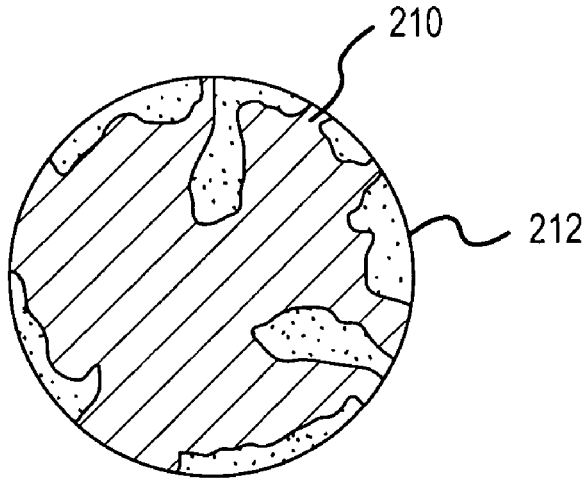
Figure 6:
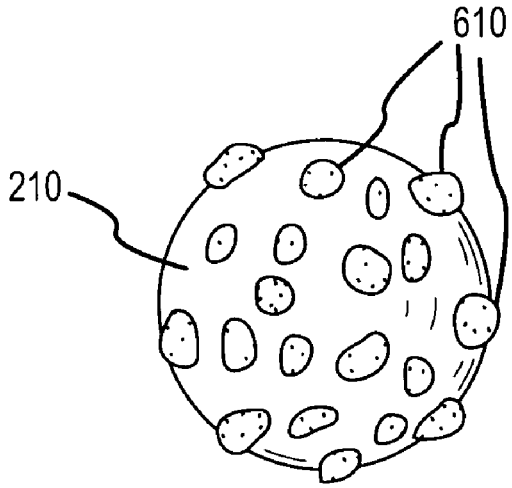

FIGS. 3A-B are cross-sectional views of suppressant particles having a colored surface and a coated surface, respectively;

FIG. 4 is an illustration of a suppressant particles partially marked with residue from thermal absorbant particles;

FIG. 5 is a cross-sectional view of a suppressant particle having a thermal absorbant permeated into its interior; and FIG. 6 is a cross-sectional view of a suppressant particle having thermal absorbant particles attached to and/or embedded in its surface.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

The present invention is described partly in terms of functional components and various processing steps. Such functional components may be realized by any number of components configured to perform the specified functions and achieve the various results. For example, the present invention may employ various elements, materials, suppressants, thermal absorbants, heat conductors, neutralizing agents, and the like, which may carry out a variety of functions. In addition, the present invention may be practiced in conjunction with any number of applications, environments, hazardous materials, and extinguishants, and the systems described are merely exemplary applications for the invention. Further, the present invention may employ any number of conventional techniques for manufacturing, assembling, dispensation, and the like.

Figure 1:
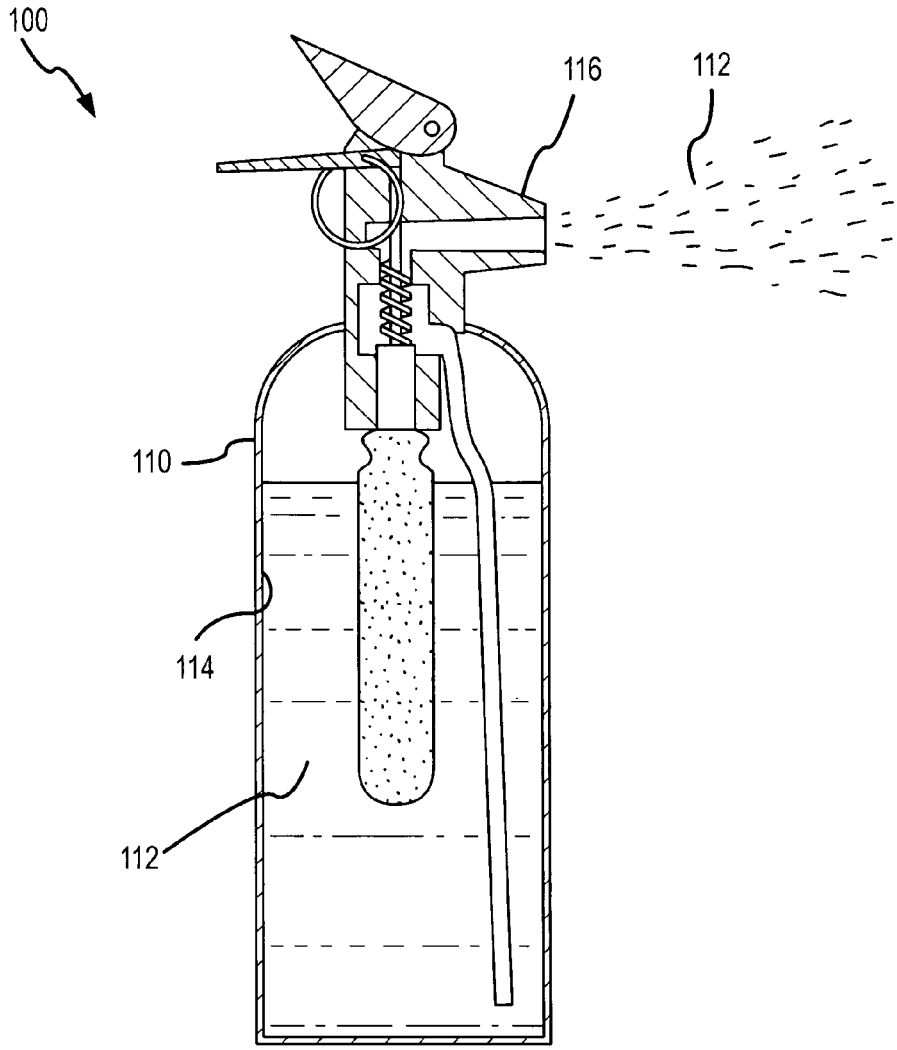
FIG. 1 is an illustration of a fire extinguishing system according to various aspects of the present invention.

Referring now to FIG. 1, a fire control system 100 for controlling and extinguishing fires according to various aspects of the present invention may be implemented in conjunction with a dispenser 110 containing an extinguishant 112. The dispenser 110 dispenses the extinguishant 112 onto or near the fire. The extinguishant 112 tends to reduce the intensity of the fire and/or extinguish the fire.

The dispenser 110 may comprise any suitable system for dispensing the extinguishant 112. The dispenser 110 may also store the extinguishant 112 until the extinguishant 112 is to be deposited on or near a fire. For example, the dispenser 110 may comprise a conventional fire extinguishing system, such as a handheld fire extinguisher, a building fire extinguishing system, a vehicular fire extinguishing system, an industrial fire extinguishing system, and the like. In the present embodiment, the dispenser 110 comprises a conventional handheld fire extinguisher having a tank 114 for storing the extinguishant 112 and a nozzle 116 for directing the extinguishant 112. In an alternative embodiment, the dispenser comprises a vehicular fire panel substantially filled with extinguishant and configured to open and dispense the extinguishant in response to a trigger event, such as an impact.

The extinguishant 112 is a material configured to control or extinguish fire in any suitable manner, such as by depriving the fire of heat, oxygen, or fuel, or otherwise disrupting the chemical processes required to sustain the fire. In the present embodiment, the extinguishant 112 comprises a suppressant and a thermal absorbant. The suppressant is configured to suppress the fire, for example a conventional fire suppressant configured to smother the fire, cut off the fuel supply, or cool the fire below the flammability temperature. The thermal absorbant is suitably configured to absorb heat from the fire, for example to reduce reflection of thermal radiation by the extinguishant 112 and/or other surfaces and/or to promote activation of the suppressant.

The suppressant is configured to reduce the fire, for example via conventional techniques. For example, the suppressant may comprise sodium or potassium bicarbonate, ammonium phosphate, monophosphate, potassium chloride, potassium salt carbon dioxide, HFC-227ea, halon or halotron-I, water, or water mist. The suppressant may comprise, however, any suitable material for suppressing fire.

In a first embodiment, the thermal absorbant is configured to reduce heat, particularly thermal radiation, reflected back into the fire or other heat source by the extinguishant 112 or other surfaces. Fires, particularly two-dimensional fires formed on liquid pools of fuel, have multiple mechanisms, including thermal radiation, that sustain the fire as well as dissipate its thermal energy. Thermal radiation tends to contribute to the sustenance and spread of fire. In particular, thermal radiation released by the fire transports heat to the liquid pool below to promote vaporization and the introduction of fuel vapor into the reaction zone to sustain the fire. Because radiation is released in all directions, however, energy also radiates away from the fuel and the fire. To maintain sufficient heat to support and sustain the fire, the lost heat must be replaced by heat from the fire.

The radiated heat may also contribute to the spread of a fire from its original location. The radiation effects of fire and the role played by thermal radiation are complex, for example due to the complexities of the direction and extent of heat losses, the radiation of heat upon surrounding structures and re-radiations back to the fire, radiation losses and generation within the surrounding hot air itself, and the respective rates of emission, absorption, and reflection from each of the constituents. Further, radiation-based heat deposition on surrounding combustible structures, such as walls and curtains, may result in their ignition and sustained fire. This mechanism can result in the spread of the fire to these surrounding structures from the original site of the fire, and can lead to a runaway fire spread condition.

Radiation-based heat may also affect the performance of dry chemical fire extinguishing particles when they are introduced into the fire region. Various types of extinguishing particles may function as a sink for the heat released by the fire and cool it below its sustenance temperature. Chemically reactive dry chemicals, such as sodium and potassium bicarbonate, also decompose when exposed to heat to release carbon dioxide and metal ions to interrupt the fire reaction chemically as well as smother it. Smaller particles appear to be more effective, possibly because the particles must vaporize rapidly for optimal effectiveness.

Most conventional dry chemical extinguishants, however, are white or near-white in the visible spectrum. Whiter surfaces tend to reflect heat from each particle back to the fire zone or the fuel source and reduce heat absorption by the particles themselves. The reflection of the heat tends to promote the robustness of the fire, and lower heat absorption tends to reduce the rate of heat extraction from the fire. The low absorption also tends to slow the rate of decomposition of the particles themselves and the corresponding generation of fire-inhibiting decomposition products to mix into the reaction zone, and as a result, particles in the region above or near the fire zone may not break down. Such particles are substantially ineffective and deposit in the air or surrounding areas.

An extinguishant 112 according to various aspects of the present invention includes a thermal absorbant to absorb heat, such as heat transferred by thermal radiation. The thermal absorbant may also or alternatively be configured to absorb heat transferred by convection and/or conduction. For example, the thermal absorbant is suitably configured to modify the outer surface and/or interior of the suppressant to absorb more thermal radiation. Consequently, less heat tends to be reflected back to maintain the fire. Further, more heat is transported into the suppressant so that heat-reactive suppressants may decompose faster to release their chemical ions and decomposition products to chemically interrupt the fire. In addition, thermal absorbant that is not in the immediate vicinity of the fire may extract additional heat from the fire and potentially inhibit ignition of surrounding combustible materials by reducing the transmission of thermal radiation to the surrounding area.

In one embodiment, the thermal absorbant provides color in conjunction with the suppressant to provide a thermally absorptive surface, such as by at least partially changing the surface to flat black and/or providing a thermal conductor into the interior of the suppressant particle. Absorptive surfaces tend to absorb instead of reflect heat. The thermal absorbant tends to promote extraction of heat from the environment and/or decomposition of the suppressant. The use of the thermal absorbant also facilitates the use of larger suppressant particles to maintain favorable throw characteristics. The thermal absorbant inhibits transport and/or reflection of heat to fuel sources, and causes the extinguishant 112 to break down in areas farther from the center of the reaction zone to create a more concentrated cloud of metal ions and inert gas molecules induced into the fire.

The thermal absorbant may be configured in any suitable manner to reduce the reflection of heat back into the fire, transmission of heat to other combustibles, and/or promote activation of the suppressant. In the present embodiment, the thermal absorbant is configured to absorb heat, such as heat transferred via thermal convection, conduction, and/or radiation. The thermal absorbant may be configured in any suitable manner to absorb heat, such as by providing a thermally absorptive color or other characteristics to the extinguishant 112.

For example, in one embodiment, the thermal absorbant may provide an appropriate color to the extinguishant 112 that tends to absorb thermal energy instead of reflecting thermal energy. The thermal absorbant may be configured to absorb as many radiation wavelengths as possible, such as a flat black color, or may be configured to absorb particular wavelengths or temperatures, such as wavelengths corresponding to carbon-based emission spectra or wavelengths associated with particular flammable materials found in a certain environment. Alternatively, the thermal absorbent may exhibit any other effective or desired color, such as various shades of gray, one or more colors mixed within the thermal absorbant, or other configurations. The thermal absorbant may be selected according to any suitable criteria, such as cost, durability, effectiveness in absorbing selected relevant wavelengths, effectiveness in coloring the extinguishant 112, flow performance, extinguishing performance, and the like. The thermal absorbant may be selected according to other criteria as well, such as other fire extinguishing capabilities, improved handling, lower toxicity, easier cleanup, or other relevant criteria.

Figure 2:
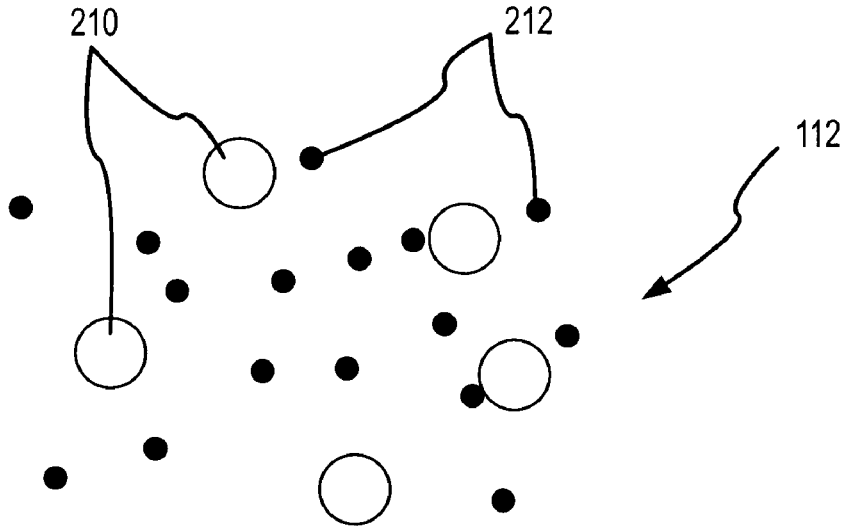
FIG. 2 is an illustration of suppressant particles or droplets mixed with thermal absorbant particles or droplets.

The thermal absorbant may operate in conjunction with the suppressant in any suitable manner. For example, the thermal absorbant is suitably disposed proximate to the suppressant, such as mixed with the suppressant, attached to the suppressant, or integrated into the suppressant. Referring to FIG. 2, in one embodiment, the extinguishant 112 comprises a liquid, gaseous, or liquefied compressed gas suppressant 210 mixed with a liquid or solid thermal absorbant 212. The suppressant 210 and the thermal absorbant 212 may be pre-mixed or mixed upon dispensation.

The thermal absorbant 212 may increase the thermal absorption of the extinguishant 112 in any suitable manner, such as by darkening the gaseous or liquid suppressant 210 or providing intermixed particles having darker surfaces for absorbing thermal radiation. For example, the thermal absorbant 212 may comprise a dye, a plurality of small particles, or other coloring to increase the thermal absorption of the extinguishant 112. The combination of the dark, such as flat black, thermal absorbant 212 with the suppressant 210 tends to reduce the reflectivity of the extinguishant 112. A liquid thermal absorbant 212 may operate as a dye or other coloration to make the overall extinguishant 112 a selected, thermally absorptive material. If a gaseous, liquid, or solid suppressant 210 is mixed with a solid thermal absorbant 212, such as a plurality of small black particles or beads, the overall reflectivity of the extinguishant 112 is reduced.

In another embodiment, the suppressant 212 is a solid or semi-solid material and the thermal absorbant 212 may be attached to the suppressant 210. The suppressant 212 may comprise any suitable material for suppressing fire or other hazard, such as a conventional dry chemical fire suppressant. The thermal absorbant 212 may be any suitable material, such as a material that is flat black or has other desired colors or characteristics, to reduce the reflection of heat from the suppressant 210 or other surfaces and/or absorb heat and transfer it to the suppressant 210.

For example, referring to FIG. 3A, the thermal absorbant 212 may be positioned on the surface of some or all of the suppressant 210 particles, such as in the form of a substantially uniform coating over the exterior surface of the suppressant 210. Alternatively, referring to FIG. 3B, the thermal absorbant 212 may comprise a surface coloration on the suppressant 210. Treating only the surface of the suppressant 210 particle tends to minimize the amount of thermal absorbant 212 required, and maintains the increased heat absorption until the coating or modified surface evaporates during melting.

The thermal absorbant 212 may be applied to the suppressant 210 particles in any suitable manner. For example, the thermal absorbant 212 may be added using a dry process, such as by applying a dye or other coloration to the suppressant 210 particles. Any appropriate technique may be used to apply the thermal absorbant 212 to the suppressant 210, however, such as deposition, soaking, spray drying, electrostatic techniques, or the like.

Referring to FIG. 4, the suppressant 210 particles may also be partially covered by the thermal absorbant 212. The partial covering of the suppressant 210 particles may be implemented in any suitable manner, such as by placing the suppressant 210 particles in contact with a thermal absorbant 212 that leaves a residue on the surface of the thermal suppressant 210 particles, for example activated charcoal particles or an appropriately colored gel. In the present embodiment, the suppressant 210 particles may be mixed with charcoal particles 410 and circulated to optimize the residue 412 delivered by the charcoal or other thermal absorbant 212.

In another embodiment, the thermal absorbant 212 is permeated or embedded into the suppressant 210. For example, referring to FIG. 5, the thermal absorbant 212 suitably comprises a material which may permeate into suppressant 210, such as a liquid dye or a material added to the suppressant during or after fabrication. Alternatively, the thermal absorbant 212 may be integrated into the suppressant 210, such as by forming the suppressant 210 from a thermally absorptive material using wet treatment, such as by dissolving the suppressant 210 particles with the dye added and forming the desired extinguishant particles by later grinding and treatment.

Alternatively, referring to FIG. 6, the thermal absorbant 212 may comprise particles formed or embedded in or attached to the suppressant 210, or vice versa. The thermal absorbant 212 may comprise any suitable heat absorbant, such as a material configured to absorb thermal radiation and/or transfer heat onto the surface of and/or into the interior of the suppressant 210.

For example, particles of iron oxide 610 or other thermal absorbent may be attached to the surface of the suppressant 210 particles. The iron oxide particles 610 are suitably smaller than the suppressant 210 particles and may be adhered to or embedded in the suppressant 210 particles in any suitable manner. Iron oxide is typically an effective thermal radiation absorbant, and may conduct heat to the suppressant surface. Iron oxide is generally considered inert in hot environments, but if transported to a flame interior or other hot area by a suppressant 210 particle, the iron oxide particles 610 may decompose and deliver highly-effective iron ions to inhibit the fire chemically.

The thermal absorbant 212 may also serve other functions as well as enhancing the thermal absorption of the extinguishant 112. For example, the suppressant 210 may comprise a heat-activated suppressant, such as sodium bicarbonate, and the thermal absorbant 212 may be configured to promote activation of the suppressant 210. As described above, the thermal absorbant 212 may be attached to or integrated with the suppressant 210. To promote activation of the suppressant 210, the thermal absorbant 212 is suitably configured to conduct or produce heat into the suppressant 210 to speed the activation of the suppressant 210.

For example, the thermal absorbant 212 may comprise a material that reacts exothermically when exposed to sufficiently high temperatures, such as activated charcoal. When exposed to a fire, thermal absorbant may generate additional heat locally to promote activation of the suppressant 210, thus tending to extinguish the fire faster.

In addition, the thermal absorbant 212 may operate as a supplementary suppressant, for example by tending to deprive the fire of oxygen or fuel. For example, the thermal absorbant 212 may comprise a thermally absorptive material having a suppressant material. Alternatively, the thermal absorbant 212 may comprise a material that is activated by exposure to heat to become a suppressant 210. In one embodiment, the thermal absorbant 212 comprises a material embedded in the suppressant 210 to promote activation of the suppressant 210, and as the suppressant 210 is activated and the thermal absorbant 212 heats up, the thermal absorbant 212 changes into a material having suppressant properties.

For example, the extinguishant 112 may comprise a sodium bicarbonate suppressant 210 having thermal absorbant 212 particles of iron oxide embedded in the suppressant particles. Upon exposure to heat, the thermal absorbant 212 particles transfer heat to the suppressant 210 particles, including the interior of the suppressant 210 particles to promote activation of the suppressant 210. In addition, the thermal absorbant 212 particles react to the heat by generating iron ions, which provide added suppressant properties for suppressing the fire.

The extinguishant 112 may also be configured to reduce or neutralize flammable components. For example, the thermal absorbant 212 may comprise a porous material, such as activated charcoal, that tends to absorb flammable gases. Alternatively, the thermal absorbant 212, the suppressant 210, or an added material to the extinguishant 112 may comprise a material that tends to neutralize or reduce the flammability of one of more flammable components.

To use a fire control system 100 and extinguishant 112 according to various aspects of the present invention, in response to detection of a fire, for example visually or automatically through a fire detection system, the extinguishant 112 is dispensed onto or near a fire or fire hazard via the dispenser 110. As the extinguishant 112 approaches and contacts the fire, the suppressant 210 tends to reduce the fire, such as by depriving the fire of fuel and/or oxygen. In addition, the thermal absorbant 212 tends to absorb heat from the fire. In particular, the thermal absorbant 212 tends to reduce reflection of thermal radiation back into the fire and/or to other surfaces. Extinguishant 112 that fails to contact the fire may nonetheless absorb heat and reduce reflection or transfer of heat from the extinguishant 112 and other surfaces, tending to inhibit spread or growth of the fire.

Further, the thermal absorbant 212 may assist in the activation of the suppressant 210. As the extinguishant 112 approaches the fire, the suppressant 210 and the thermal absorbant 212 absorb heat, which tends to activate the suppressant 210. The thermal absorbant 212 absorbs heat faster than the suppressant 210, which is transferred to the suppressant 210, promoting the faster activation of the suppressant 210. Activation of the suppressant 210 may be further enhanced for suppressants 210 having thermal absorbants 212 penetrating the outer surface of the suppressant 210, such that the thermal absorbant 212 may convey heat directly to the interior of the suppressant 210.

In addition, the thermal absorbant 212 may convert into a supplementary suppressant. As the thermal absorbant 212 absorbs heat from the fire, the thermal absorbant 212 may change into a material having suppressant properties. The thermal absorbant 212 may also absorb and/or neutralize flammable materials in the environment, such as by absorbing flammable gases into pores in the thermal absorbant.

The particular implementations shown and described are illustrative of the invention and its best mode and are not intended to otherwise limit the scope of the present invention in any way. Indeed, for the sake of brevity, conventional manufacturing, connection, preparation, and other functional aspects of the system may not be described in detail. Furthermore, the components shown in the various figures are intended to represent exemplary functional relationships and/or physical couplings between the various elements. Many alternative or additional functional relationships or physical connections may be present in a practical system.

The present invention has been described above with reference to a preferred embodiment. However, changes and modifications may be made to the preferred embodiment without departing from the scope of the present invention. These and other changes or modifications are intended to be included within the scope of the present invention.

The invention claimed is:

1. A fire extinguishant, comprising:

a suppressant; and a thermal absorbant configured to absorb radiation, wherein the thermal absorbant is proximate to the suppressant.

2. A fire extinguishant according to claim 1, wherein the thermal absorbant comprises a surface modification to the suppressant.

3. A fire extinguishant according to claim 2, wherein the surface modification comprises a surface color added to the suppressant.

4. A fire extinguishant according to claim 3, wherein the surface color comprises substantially flat black.

5. A fire extinguishant according to claim 2, wherein the surface modification comprises a residue formed on a surface of the suppressant.

6. A fire extinguishant according to claim 5, wherein the residue comprises a charcoal residue.

7. A fire extinguishant according to claim 1, wherein the thermal absorbant is configured to absorb selected wavelengths.

8. A fire extinguishant according to claim 1, wherein the thermal absorbant is configured to promote activation of the suppressant in response to heat.

9. A fire extinguishant according to claim 8, wherein the thermal absorbant is configured to transfer heat to the suppressant.

10. A fire extinguishant according to claim 9, wherein the thermal absorbant is configured to react exothermically to heat.

11. A fire extinguishant according to claim 1, wherein the thermal absorbant comprises at least one of a coating, a dye, a residue, an embedded particle, and an independent particle.

12. A fire extinguishant according to claim 1, wherein the thermal absorbant comprises a plurality of particles mixed with the suppressant.

13. A fire extinguishant according to claim 1, wherein:

the suppressant comprises a plurality of particles;

the thermal absorbant comprises a plurality of particles; and the thermal absorbant particles are attached to the suppressant particles.

14. A fire extinguishant according to claim 13, wherein the thermal absorbant comprises iron oxide.

15. A fire extinguishant according to claim 1, wherein:

the suppressant comprises a liquid; and the thermal absorbant comprises at least one of a liquid and a plurality of particles.

16. A fire extinguishant according to claim 1, wherein the thermal absorbant permeates the suppressant.

17. A fire extinguishant according to claim 1, wherein the thermal absorbant comprises a supplementary fire suppressant.

18. A fire extinguishant comprising a suppressant having a source of color configured to absorb thermal radiation.

19. A fire extinguishant according to claim 18, wherein the source of color comprises a surface modification to the suppressant.

20. A fire extinguishant according to claim 19, wherein the surface modification comprises a surface color added to the suppressant.

21. A fire extinguishant according to claim 20, wherein the surface color comprises substantially flat black.

22. A fire extinguishant according to claim 19, wherein the surface modification comprises a residue formed on a surface of the suppressant.

23. A fire extinguishant according to claim 22, wherein the residue comprises a charcoal residue.

24. A fire extinguishant according to claim 18, wherein the source of color is configured to absorb selected wavelengths.

25. A fire extinguishant according to claim 18, wherein the source of color is configured to promote activation of the suppressant in response to heat.

26. A fire extinguishant according to claim 25, wherein the thermal absorbant is configured to transfer heat to the suppressant.

27. A fire extinguishant according to claim 18, wherein:

the suppressant comprises a liquid; and the source of color comprises at least one of a liquid and a plurality of particles.

28. A fire extinguishant according to claim 18, wherein the source of color permeates the suppressant.

29. A fire control system, comprising:

an extinguishant, comprising:

a suppressant; and a thermal absorbant configured to absorb radiation, wherein the thermal absorbant is proximate to the suppressant; and a dispenser configured to contain the extinguishant.

30. A fire control system according to claim 29, wherein the thermal absorbant comprises a surface modification to the suppressant.

31. A fire control system according to claim 30, wherein the surface modification comprises a surface color added to the suppressant.

32. A fire extinguishant according to claim 31, wherein the surface color comprises substantially flat black.

33. A fire extinguishant according to claim 30, wherein the surface modification comprises a residue formed on a surface of the suppressant.

34. A fire extinguishant according to claim 33, wherein the residue comprises a charcoal residue.

35. A fire extinguishant according to claim 29, wherein the thermal absorbant is configured to absorb selected wavelengths.

36. A fire extinguishant according to claim 29, wherein the thermal absorbant is configured to promote activation of the suppressant in response to heat.

37. A fire extinguishant according to claim 36, wherein the thermal absorbant is configured to transfer heat to the suppressant.

38. A fire extinguishant according to claim 37, wherein the thermal absorbant is configured to react exothermically to heat.

39. A fire extinguishant according to claim 28, wherein the thermal absorbant comprises at least one of a coating, a dye, a residue, an embedded particle, and an independent particle.

40. A fire extinguishant according to claim 29, wherein the thermal absorbant comprises a plurality of particles mixed with the suppressant.

41. A fire extinguishant according to claim 29, wherein:

the suppressant comprises a plurality of particles;

the thermal absorbant comprises a plurality of particles; and the thermal absorbant particles are attached to the suppressant particles.

42. A fire extinguishant according to claim 41, wherein the thermal absorbant particles comprise iron oxide.

43. A fire extinguishant according to claim 29, wherein:

the suppressant comprises a liquid; and the thermal absorbant comprises at least one of a liquid and a plurality of particles.

44. A fire extinguishant according to claim 29, wherein the thermal absorbant permeates the suppressant.

45. A fire extinguishant according to claim 29, wherein the thermal absorbant comprises a supplementary fire suppressant.

46. A method for extinguishing a fire, comprising:

detecting the fire; and dispensing an extinguishant proximate to the fire, wherein the extinguishant comprises:

a suppressant; and a thermal absorbant configured to absorb radiation, wherein the thermal absorbant is proximate to the suppressant.

47. A method for extinguishing a fire according to claim 46, wherein the thermal absorbant is disposed between the fire and a nearby combustible material.

48. A method for extinguishing a fire according to claim 46, wherein the thermal absorbant comprises a surface modification to the suppressant.

49. A method for extinguishing a fire according to claim 48, wherein the surface modification comprises a surface color added to the suppressant.

50. A method for extinguishing a fire according to claim 49, wherein the surface color comprises substantially flat black.

51. A method for extinguishing a fire according to claim 48, wherein the surface modification comprises a residue formed on a surface of the suppressant.

52. A method for extinguishing a fire according to claim 51, wherein the residue comprises a charcoal residue.

53. A method for extinguishing a fire according to claim 46, wherein the thermal absorbant is configured to absorb selected wavelengths.

54. A method for extinguishing a fire according to claim 46, wherein the thermal absorbant is configured to promote activation of the suppressant in response to heat.

55. A method for extinguishing a fire according to claim 54, wherein the thermal absorbant is configured to transfer heat to the suppressant.

56. A method for extinguishing a fire according to claim 55, wherein the thermal absorbant is configured to react exothermically to heat.

57. A method for extinguishing a fire according to claim 46, wherein the thermal absorbant comprises at least one of a coating, a dye, a residue, an embedded particle, and an independent particle.

58. A method for extinguishing a fire according to claim 46, wherein the thermal absorbant comprises a plurality of particles mixed with the suppressant.

59. A method for extinguishing a fire according to claim 46, wherein:

the suppressant comprises a plurality of particles;

the thermal absorbant comprises a plurality of particles; and the thermal absorbant particles are attached to the suppressant particles.

60. A method for extinguishing a fire according to claim 59, wherein the thermal absorbant comprises iron oxide.

61. A method for extinguishing a fire according to claim 46, wherein:

the suppressant comprises a liquid; and the thermal absorbant comprises at least one of a liquid and a plurality of particles.

62. A method for extinguishing a fire according to claim 46, wherein the thermal absorbant permeates the suppressant.

63. A method for extinguishing a fire according to claim 46, wherein the thermal absorbant comprises a supplementary fire suppressant.

* * * * *